US008161593B2

(12) United States Patent
Noble

(10) Patent No.: US 8,161,593 B2
(45) Date of Patent: Apr. 24, 2012

(54) MOP

(75) Inventor: Edward J. Noble, Corona Del Mar, CA (US)

(73) Assignee: Noble Ideas II, Inc., Coronado, CA (US)

( * ) Notice: Subject to any disclaimer, the term of this patent is extended or adjusted under 35 U.S.C. 154(b) by 528 days.

(21) Appl. No.: 12/341,061

(22) Filed: Dec. 22, 2008

(65) Prior Publication Data

US 2009/0158542 A1 Jun. 25, 2009

Related U.S. Application Data

(60) Provisional application No. 61/016,320, filed on Dec. 21, 2007.

(51) Int. Cl.
*A47L 13/20* (2006.01)
*A47L 13/24* (2006.01)

(52) U.S. Cl. ..... 15/228; 15/231

(58) Field of Classification Search ..... 15/98, 99, 15/119.1, 228, 231, 232
See application file for complete search history.

(56) References Cited

U.S. PATENT DOCUMENTS

| | | | | | |
|---|---|---|---|---|---|
| 899,725 | A | * | 9/1908 | Goodier | 15/228 |
| 899,726 | A | * | 9/1908 | Goodier | 15/228 |
| 995,785 | A | * | 6/1911 | Grimson | 15/105 |
| 1,130,064 | A | * | 3/1915 | Buchanan | 15/228 |
| 1,473,146 | A | * | 11/1923 | Forcier | 15/228 |
| 2,394,585 | A | * | 2/1946 | Bailey | 15/104.94 |
| 2,452,744 | A | * | 11/1948 | Gardner | 242/539 |
| 2,601,537 | A | * | 6/1952 | Lofgren | 15/114 |
| 2,690,582 | A | * | 10/1954 | Sundell | 15/228 |
| 2,810,149 | A | * | 10/1957 | Guelker | 15/231 |
| 2,828,501 | A | * | 4/1958 | Brown, Sr. | 15/114 |
| 3,116,504 | A | * | 1/1964 | Unterbrink et al. | 15/231 |
| 3,201,817 | A | * | 8/1965 | Atchley | 15/231 |
| 3,613,146 | A | * | 10/1971 | Oviatt | 15/231 |
| 3,641,612 | A | * | 2/1972 | Clurman et al. | 15/231 |
| 4,083,075 | A | * | 4/1978 | Hester | 15/104.002 |
| 4,106,153 | A | * | 8/1978 | Lemelson | 15/231 |
| 4,121,315 | A | * | 10/1978 | Buser | 15/228 |
| 4,510,642 | A | * | 4/1985 | Ingermann et al. | 15/231 |
| 4,550,467 | A | * | 11/1985 | Johnson et al. | 15/228 |
| 4,562,610 | A | * | 1/1986 | Davis et al. | 15/228 |
| 5,092,699 | A | * | 3/1992 | Silvenis | 401/21 |
| 5,675,858 | A | | 10/1997 | Von Meyer | |
| 5,701,630 | A | * | 12/1997 | Liao | 15/228 |
| 6,032,318 | A | * | 3/2000 | McLaughlin et al. | 15/228 |
| 6,108,848 | A | | 8/2000 | Monahan | |
| 6,223,378 | B1 | * | 5/2001 | Watellier | 15/103.5 |
| RE37,415 | E | | 10/2001 | Petner | |
| 6,477,731 | B2 | | 11/2002 | Monahan | |
| 6,550,094 | B1 | | 4/2003 | Hurtado | |

(Continued)

FOREIGN PATENT DOCUMENTS

| | | | |
|---|---|---|---|
| JP | 10-262887 | * | 10/1998 |

(Continued)

*Primary Examiner* — Mark Spisich
(74) *Attorney, Agent, or Firm* — Orrick, Herrington & Sutcliffe LLP

(57) ABSTRACT

A mop comprising a roller and mop pad system and a roll of absorbent mopping material operably coupled to the roller and mop pad system. The mop enables the user to replace the soiled mopping material with clean mopping material by using the roller system to roll the soiled mopping material away from the mop pad and thus replace the soiled mopping material with clean mopping material from a supply roll.

2 Claims, 8 Drawing Sheets

U.S. PATENT DOCUMENTS

| | | | |
|---|---|---|---|
| 6,625,838 | B2 | 9/2003 | Laux |
| 6,745,429 | B2 | 6/2004 | Ng |
| 6,892,415 | B2 | 5/2005 | Libman |
| 6,893,180 | B2 | 5/2005 | Hall |
| 6,979,371 | B1 | 12/2005 | Policicchio |
| 6,986,618 | B2 | 1/2006 | Hall |
| 6,986,619 | B2 | 1/2006 | Hall |
| 7,028,364 | B2 | 4/2006 | Policicchio |
| 7,144,173 | B2 | 12/2006 | Policicchio |
| 7,163,349 | B2 | 1/2007 | Policicchio |

FOREIGN PATENT DOCUMENTS

| | | | |
|---|---|---|---|
| WO | 2004/047607 | * | 6/2004 |

* cited by examiner

MOP

CROSS-REFERENCE TO RELATED APPLICATION

This application claims the benefit of U.S. Provisional Application Ser. No. 61/016,320 filed Dec. 21, 2007, which is fully incorporated herein by reference.

FIELD

The present invention relates generally to mops, and more particularly to a novel mop design that facilitates more effective, efficient, and cleaner mopping of floor surfaces, including wood, stone, and/or artificial floor materials, and the like.

BACKGROUND

Mops are used to clean wood, stone and artificial floor surfaces in order leave them cleaner than by just sweeping or vacuuming the floor surface. In its basic form, a mop consists of an attachment device at the end of a pole or handle to which a rag can be attached and then submerged into a pail of water or cleaning solution. The wet rag is wrung out and then used to apply the water and/or a cleaning solution to the floor surface. The mop is used to clean and dislodge debris from the floor surface. The mop is then re-submerged in the water or cleaning solution to rinse the mop. Once rinsed, the mop is again wrung out and the mop is then used to clean another section of the floor surface being cleaned.

Traditionally, the two biggest problems such wet mopping have been: (a) as one rinses the mop in the water or cleaning solution, the water or cleaning solution becomes dirty as the mopping procedure proceeds, requiring a constant refreshing of the water or cleaning solution in order to avoid using dirty water or cleaning solution to clean the floor surface; and (b) the act of wringing out the mop after one submerges the mop in the water or cleaning solution. This requires the user to use one's hands to wring the mop out, thus touching the unclean mop and dirty water or cleaning solution every time the mop is rinsed.

There are a variety of wet mops available in the market today, from the conventional mop consisting of a device at the end of a pole/handle to which a rag, absorbent cord-like strands, or absorbent cloth fiber-like strands are connected to wet mops that include a wringing device attached to the mops to make wringing out the mop surface easier and/or cleaner after rinsing the mop in the water or cleaning solution. (See, i.e., U.S. Pat. Nos. 6,745,429, 6,625,838, 6,477,731, 5,675,858, 6,108,848.)

Other mops, such as sponge mops, consist of a pole/handle and a sponge-like device (roll or pad) attached at the end of the pole/handle to clean floor surfaces. The sponge devices can be of different dimensions/thickness and in various shapes. Some sponge mops include a wringing device. In addition, some sponge mops include scrubbing pads with bristles to clean hard-to-remove debris on floors. See, e.g., U.S. Pat. Nos. Re37415 and 6,550,094, 6,892,415

While the problems associated with wringing-out traditional and sponge mops have been lessened by wringing-out devices incorporated into the mops, the need to continuously refresh the water or cleaning solution in order to avoid using dirty water or cleaning solution to clean the floor surface persists. Pad mops, however, have been developed to address this problem.

Pad mops typically consist of two primary elements: 1) a pole/handle with a flat square or rectangular mop pad at the bottom end and 2) specially designed absorbent pads that attaches to the mop pad to mop the floor surfaces. (See, e.g., U.S. Pat. Nos. 7,163,349, 7,144,173, 7,028,364, 6,986,619 and 616, 6,893,180, 7,144,173, 7,028,364, 6,979,371 and the like). The absorbent pads act as the mop and can be changed as they become soiled while mopping the floor surface. The rectangular mop pad is connected to the pole/handle via a universal joint, which enables the mop pad to be turned in various positions in order to get into tight places and under furniture.

The pad mops may also include water or cleaning solution bottle attachments on the pole/handle that allow the user to spray a cleaning solution in front of the cleaning pad as one mops the floor surface. This eliminates the need for the pail of water or cleaning solution and the need to rinse out the mop surface. As the special absorbent pad connected to the mop pad become dirty, the user replaces the pad with a clean pad, thus eliminating cleaning floors with dirty absorbent mop pads and dirty cleaning water and/or cleaning solutions.

While pad mops are a big improvement over conventional mops and sponge mops with wringing devices, the pad mops still have drawbacks. The special absorbent pads that attach to the mop pad at the end of the mop handle are small in size (usually 8 inches long by 4-5 inches wide) and, thus, they become dirty quite quickly and have to be replaced quite often in order to avoid mopping the floor surface with a dirty pad. The special absorbent pads also have to be made of materials that can glide over the floor surfaces while absorbing any liquid on the floor surface. The reason the pads have to easily glide over the surface is that if the absorbent pads were made of materials that absorb and clean in a more aggressive manner, the absorbent pads would stick to the floor surfaces causing the mop pad to fold under itself as one pushes and pulls the pad mop on the floor surfaces, rendering the pad mop useless. Further, in order for the absorbent pad to glide over the floor surface being mopped, the rectangular mop pad needs to be made of a stiff or hard material. As a result, the absorbent pad cannot clean or mop as well as conventional mops and sponge mops as they are not as flexible and absorbent and cannot get into small groves, holes, or imperfections in the floor surface. Moreover, as one uses a pad mop on a floor surface, one must constantly replace the soiled absorbent mop pads, thus coming in physical contact with the soiled pads and cleaning solution in order to replace the absorbent pad. The cost of the absorbent pads which attach to the mop pads make wet-mopping a floor an expensive proposition without providing exceptional cleaning.

Thus, an improved mop is desirable.

SUMMARY

The embodiments and examples provided herein are generally directed to an improved mop comprising a roller and mop pad system and a roll of absorbent mopping material operably coupled to the roller and mop pad system. The mop enables the user to replace the soiled mopping material with clean mopping material by using the roller system to roll the soiled mopping material away from the mop pad and thus replace the soiled mopping material with clean mopping material from a supply roll.

Other objects and features of the present invention will become apparent from consideration of the following description taken in conjunction with the accompanying drawings.

BRIEF DESCRIPTION OF THE FIGURES

The details of the invention, both as to its structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

DESCRIPTION OF THE PREFERRED EMBODIMENTS

Each of the features and teachings disclosed below can be utilized separately or in conjunction with other features and teachings to provide a novel mop. Representative examples of the present invention, which examples utilize many of these additional features and teachings both separately and in combination, will now be described in further detail with reference to the attached drawings. This detailed description is merely intended to teach a person of skill in the art further details for practicing preferred aspects of the present teachings and is not intended to limit the scope of the invention. Therefore, combinations of features and steps disclosed in the following detail description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

Figure 1:
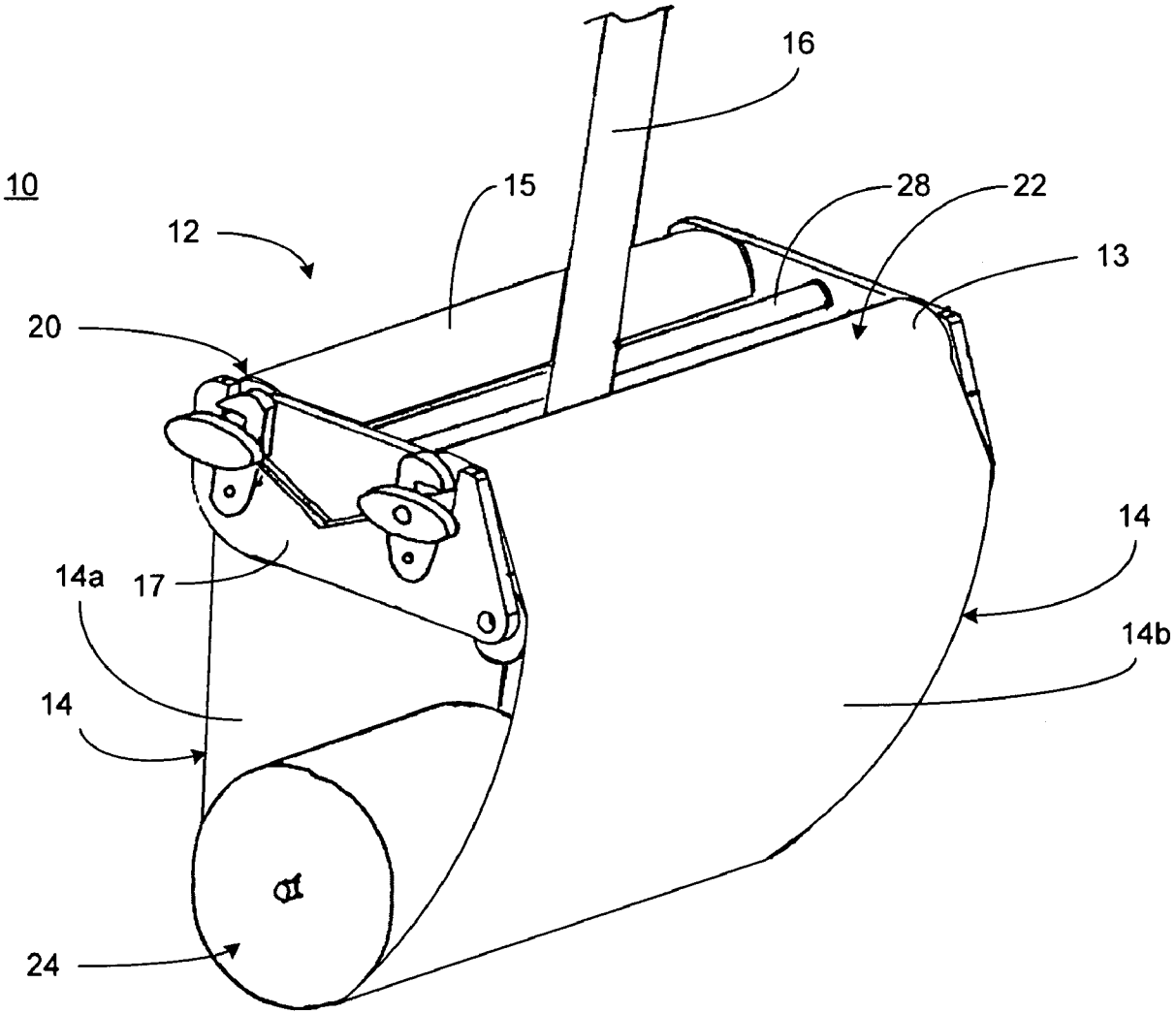
FIG. 1 a perspective view of an embodiment of a mop.
Figure 2:
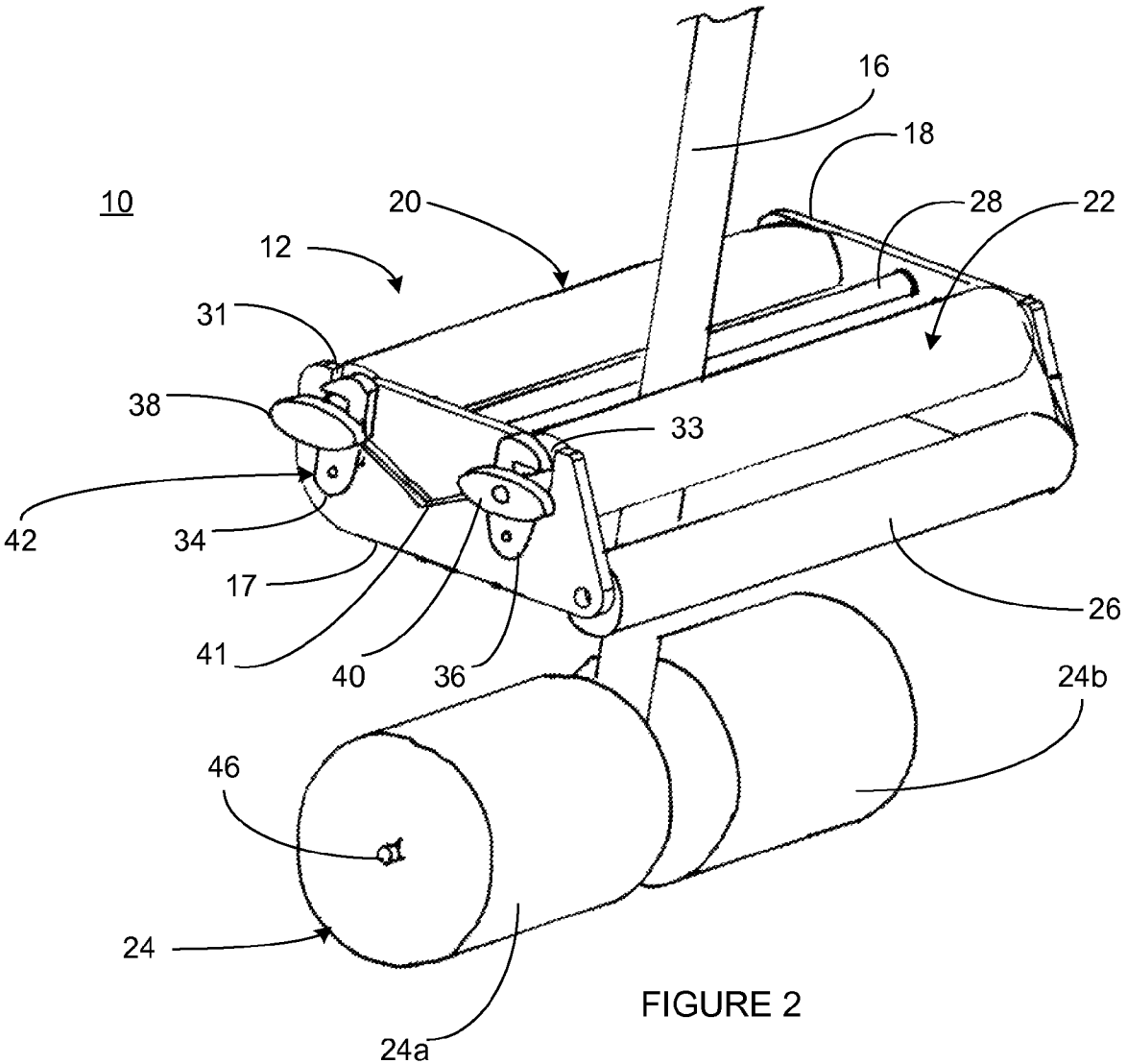
FIG. 2 is a perspective view of the mop presented in FIG. 1 without the mopping material.
Figure 3:
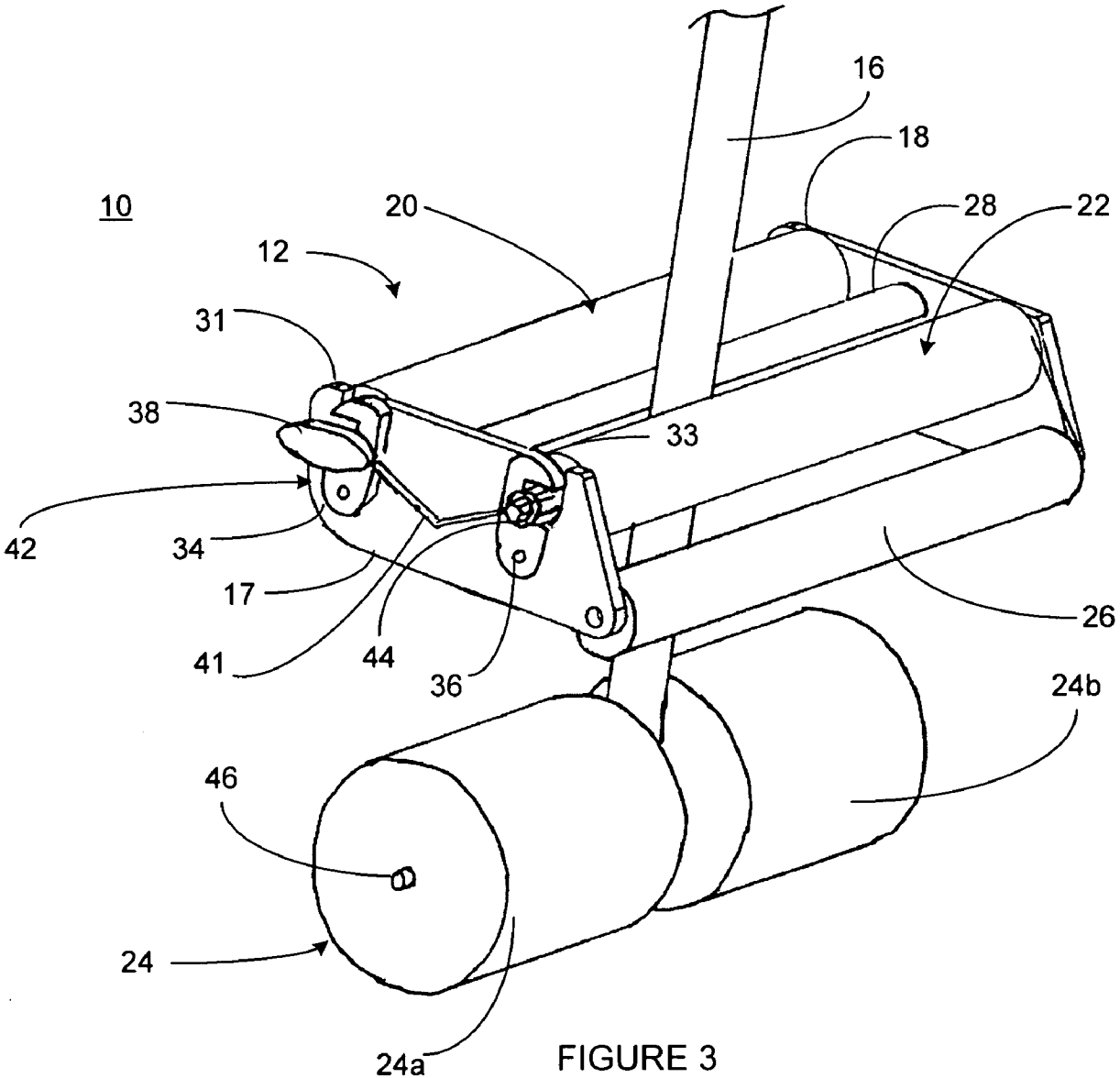
FIG. 3 is a perspective view of the mop presented in FIG. 1 without the mopping material.
Figure 4:
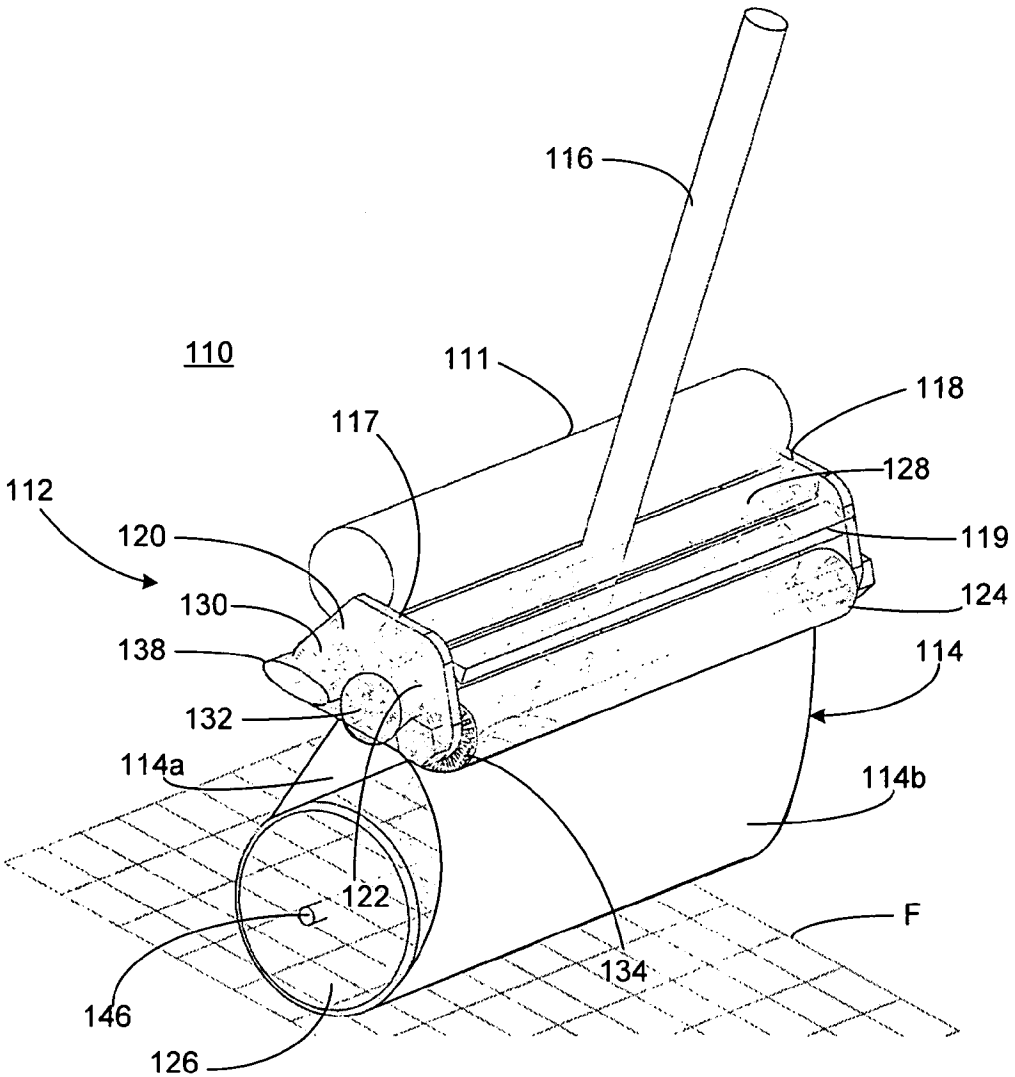
FIG. 4 is a perspective view of another embodiment of a mop.

Turning to the figures, in one embodiment, as depicted in FIGS. 1 through 3, a mop 10 comprises a roller and mop pad system 12, which is the main framework of the mopping device 10, coupled to a mop handle 16. A sheet of absorbent mopping material 14 is operably coupled to the roller and mop pad system 12. The mopping material 14 is used to mop and clean a floor surface. The mop 10 enables the user to replace the soiled mopping material 14*b* with clean mopping material 14*a* by simply rolling up the soiled mopping material 14*b* on to a take-up roll 13 mounted on a take-up roller 22, thus replacing the soiled mopping material 14*b* with clean mopping material 14*a* from the supply roll 15 mounted on a supply roller 20.

The roller and mop pad system 12 includes a supply roller 20, a take-up roller 22, a guide roller pad 26 and a split roller mop pad 24. The shafts 44 of the supply and take-up rollers 20 and 22 are releasably received in slots 31 and 33 and holes formed in side support structures or carriages 17 and 18. The side support structures 17 and 18 are fixed relative to one another and coupled to cross bar 28, which is coupled to the handle 16. The guide roller pad 26 is rotatably fixed to side supports 17 and 18. The split roller pad 24 includes first and second roller pads 24*a* and 24*b* coupled to a shaft 46 which is rotatably coupled to the handle 16. Alternatively, the shaft 46 can be fixedly coupled to the handle 16 and the first and second roller pads 24*a* and 24*b* can be rotatably coupled to the shaft 46.

The material of which the absorbent mopping material 14 is made of can be either a very absorbent fabric or paper, or a combination of fabric (to provide strength so it does not tear) and paper (such as that which paper towels are made of) to provide absorption. The two rolls of the absorbent mopping material include a primary or supply roll 15 which is made up of new, unused, unsoiled mopping material 14*a*, which is mounted on the supply roller 20, and a take-up roll 13 which is mounted on the take-up roller 22. In operation, the take up roll 13 is coupled to the primary roll 15 via a continuous sheet of mopping material 14. The used, soiled mopping material 14*b* is rolled up on the take up roll 13 as the user mops the floor surface. The take up roll 13 preferably includes a means such as hooks, spikes, clamps or the like, used to grab, hold or retain the leading edge of the sheet of mopping material 14 to enable the mopping material to be rolled up on the take up roll 13. The take up roll 13 need not be a separate or additional component mounted on the take up roller 22 but may merely be the used, soled mopping material 14*b* rolled up on the take up roller 22 where the grabbing, holding or retaining means is incorporated in the take up roller 22.

As depicted, one of the carriage or side supports 17 has two slotted openings 31 and 33 formed from a top surface. The square, hexagonal, or octagonal portions of the shafts 44 of the supply and take-up rollers 20 and 22 are received in the slots 31 and 32. The opposite carriage or side support 18 where the opposite ends of the shafts 44 are received. The shafts 44 preferably include a cavity or recess into which shafts or stems of adjustment knobs 38 and 40 can be inserted. The knobs 38 and 40 can be turned in order to move or transfer clean material 14*a* from the supply roll 15 to the bottom of the split roller pad 24 and take-up the soiled material on the take-up roll 13.

On the face of the carriage or side support 17 there are two spring-loaded locking catches 34 and 36 attached to a spring 41 that holds the locking catches 34 and 36 in place, and prevents the supply and take-up rollers 20 and 22 from revolving or rotating as the mop 10 is being used. By pushing down on the spring 41, the locking catches 34 and 36 pull back and away from the shafts 44 of the supply and take-up rollers 20 and 22, allowing the user to turn the adjustment knobs 38 and 40. The adjustment knob 38 of the supply roller 20 is rotated to release clean mopping material 14*a* from the supply roll 15 and the adjustment knob 40 on the take-up roller is rotated 22 in order to take-up the soiled material 14*b* around the roller pad 24 and replacing the soiled material 14*b* around the roller pad 24 with clean mopping material 14*a* from the supply roll 15.

The split roller pad 24 is preferably made of soft/flexible material comprising rubber, foam, or cloth-like material. The split roller pad 24 around which the absorbent material 14 revolves as the user mops the floor surfaces, provides support for a primary mopping surface of the mop 10. The split roller pad 24 revolves around its center axis in order to allow the absorbent material 14 to easily revolve around the split roller pad 24 as the user unwinds the clean absorbent material 14*a* from the primary or supply roll 15 and winds the soiled material 14*b* over the take-up roll 13.

The guide roller pad 26 allows the absorbent material 14 to roll over it as the material 14 is threaded back up from the roller mop pad 24 to the take-up roll 13. The low-angle guide roller pad 26 provides support for an additional mopping surface as the angle of the mop 10 is decreased (as when the user lowers the mop 10 to get under furniture or hard to reach places). Like the roller mop pad 24, the low-angle guide roller pad 26 is made of soft, flexible material, such as rubber, foam, or cloth-like material.

Figure 8B:
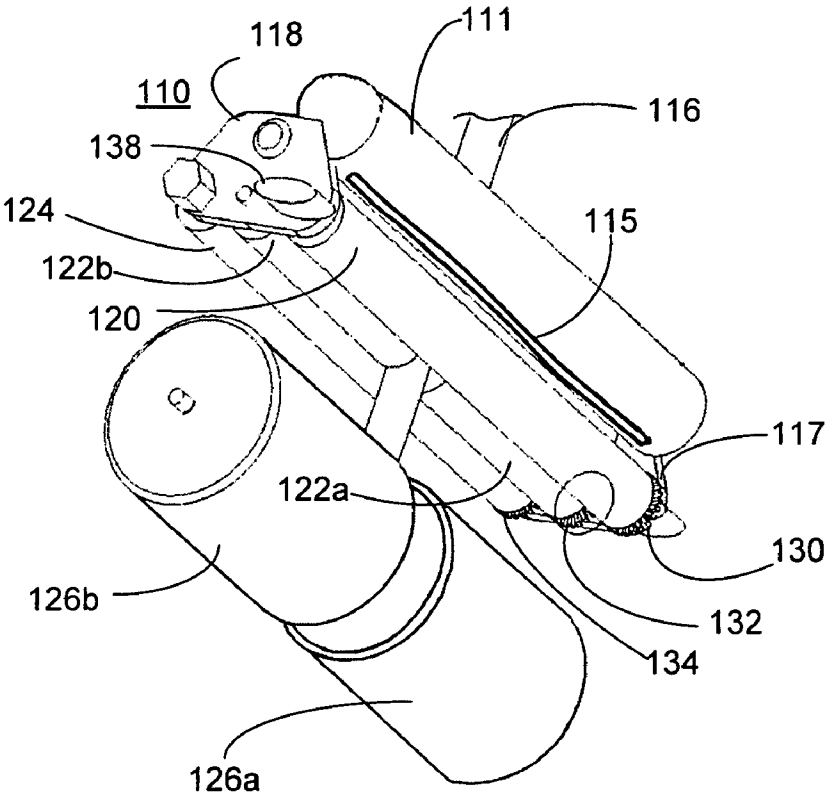
FIGS. 8A-8B are perspective views of the mop of FIG. 4 further showing the supply roll canister and supply slot.
Figure 8A:
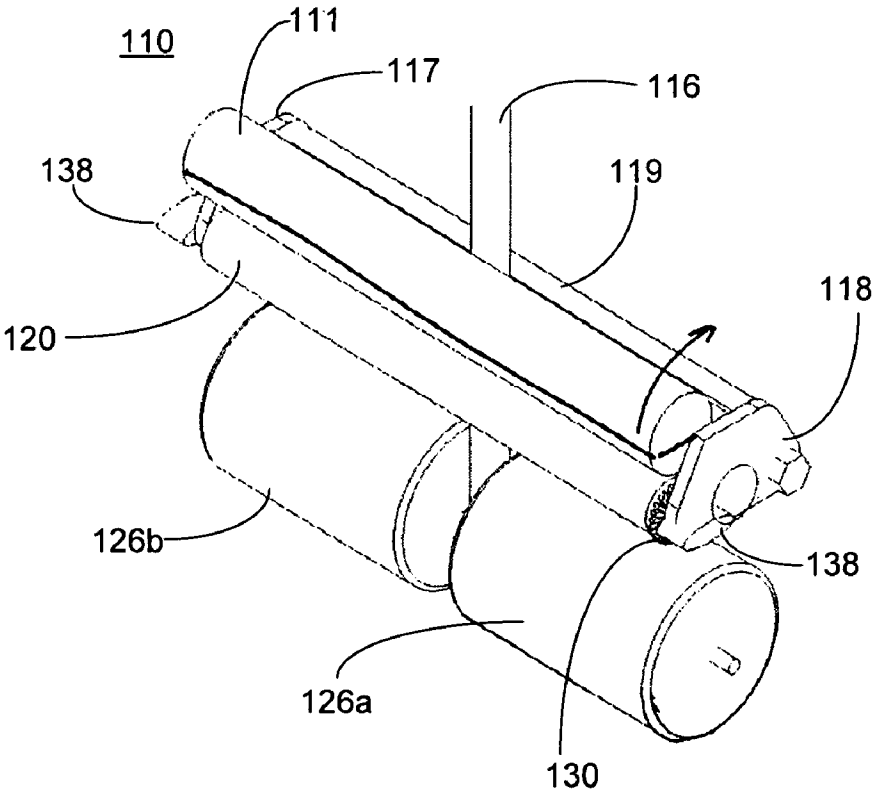

In another embodiment depicted in FIGS. 4 through 8B, a mop 110 comprises a mopping material holder 111, a roller mechanism 112, a roller pad 126 and mopping material 114 stored in the holder 111 and threaded through the roller mechanism 112 and extending around the roller pad 126. As depicted in FIGS. 8A and 8B, the holder 111 will open up allowing the user to put a roll of mopping material or rolled up mopping material 113 into the holder 111. The holder 111 includes a long slot 115 along the bottom of the material holder 111 through which the mopping material 114 is fed through and then threaded through the roller mechanism 112 and extended around the roller pad 126.

The roller mechanism 112 includes side supports 117 and 118 which hold first, second and third rollers 120, 122 and 124 in place. A crossbar 128 couples the side supports 117 and 118 to a mop handle 116 of the mop 110. The roller pad 126 includes first and second roller pads 126*a* and 126*b* rotatably mounted on a shaft 146 which is connected to the mop handle 116 toward the bottom of the mop handle 116. The shaft 146 is received through a slot 116*a* form in the handle 116 and can be adjusted up or down along the mop handle 116 and fixedly positioned by tightening the shaft 146.

The three rollers 120, 122 and 124 are preferably made of a rubber material and preferably press against one another and are operably coupled to one another by intermeshed gears 130, 132 and 134 mounted on the ends of the shafts of the three rollers 120, 122 and 124. When the user rotates the first roller 120 clockwise, the second roller 122 rotates counter-clockwise and third roller 124 rotates clockwise. The second roller 122 comprises two rollers 122*a* and 122*b* positioned on either side of the mop handle 116. Alternatively, the rollers 120, 122 and 124 could be ribbed or gear shape, thus eliminating the need for gears being mounted on the shafts of the rollers 120, 122 and 124.

Figure 5:
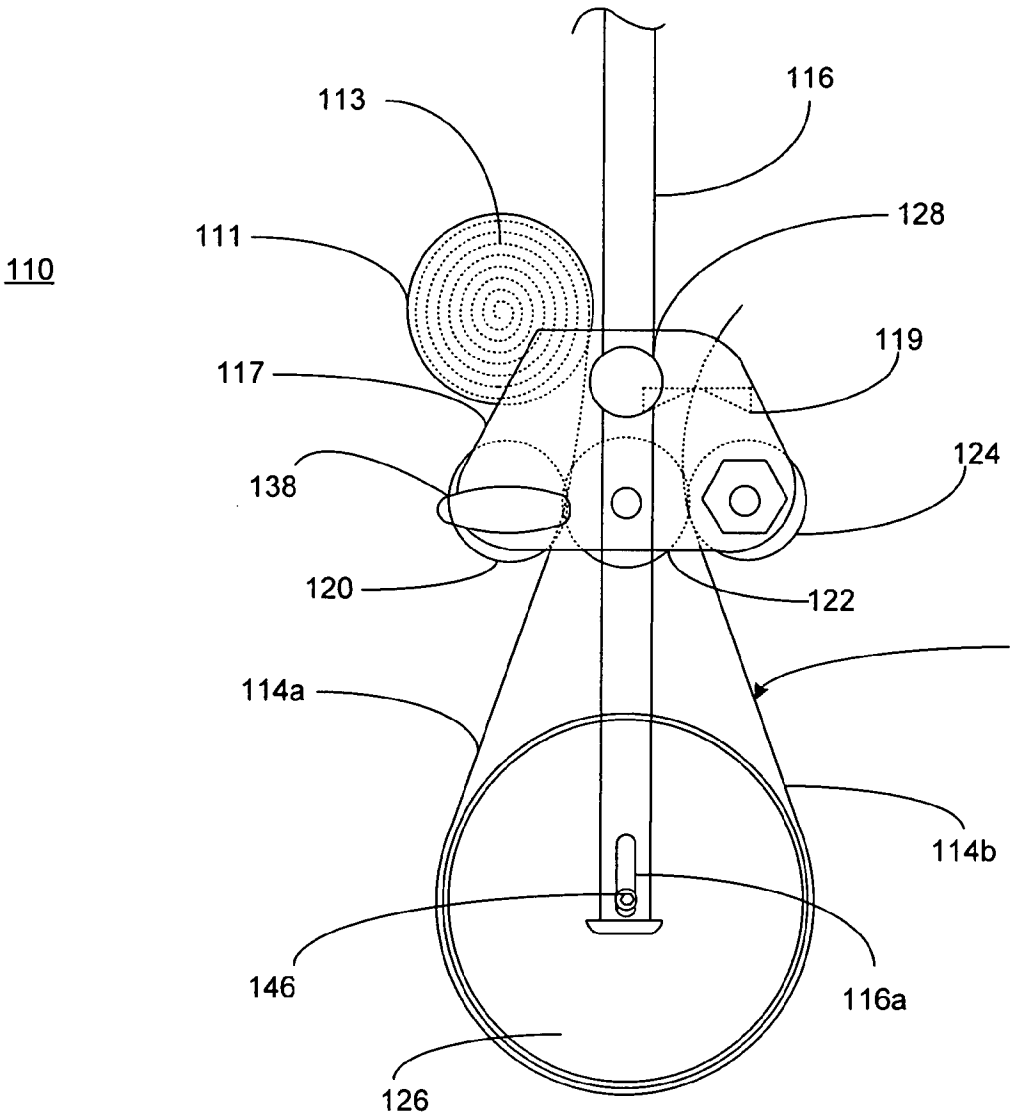
FIG. 5 is a side view of the mop of FIG. 4.
Figure 6:
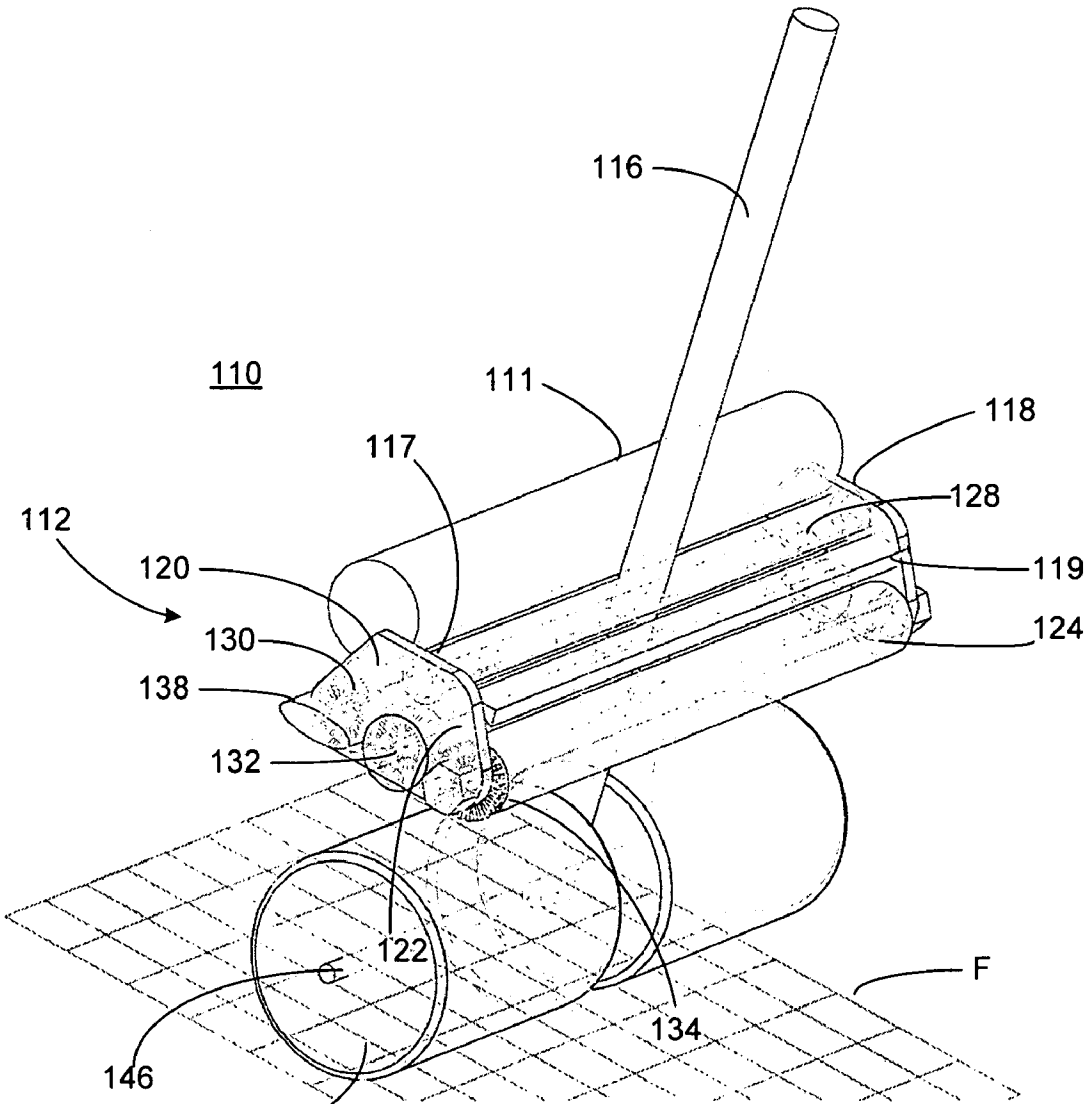
FIG. 6 is a perspective view of the mop presented in FIG. 4 without the mopping material.
Figure 7:
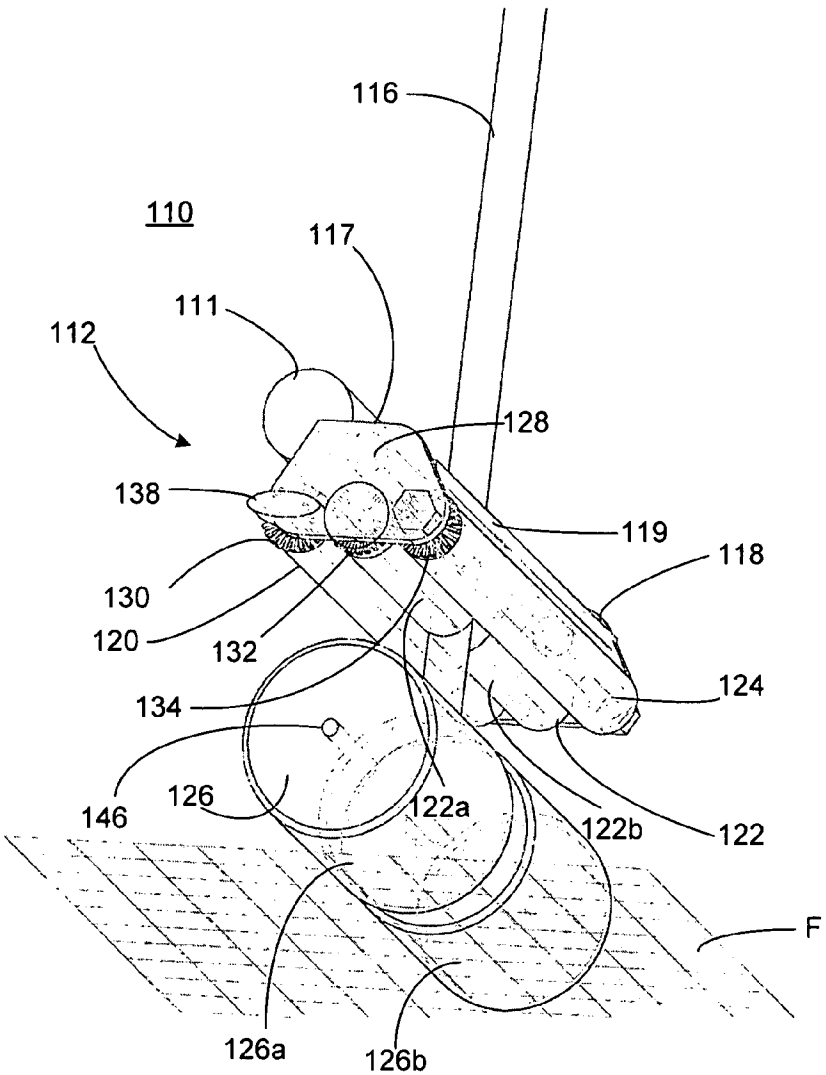
FIG. 7 is a perspective view of the mop presented in FIG. 4 without the mopping material.

As depicted in FIG. 5, a roll 113 of rolled up mopping material 114 is housed in holder 111. The mopping material 114 is fed through the slot 115 at the bottom of the mopping material holder 111 and passes between the first and second rollers 120 and 122. The sheet of mopping material 114 extends around the roller pad 126 and back up between the second and third rollers 122 and 124, and then up past the cutter or cutting element 119. Since the rollers 120, 122 and 124 are pressed against one another and connected by intermeshing gears 130, 132 and 134, they all operate and turn simultaneously, and the mopping material 114 is held in place by the pressure exerted by the rollers 120, 122 and 124. In addition to the gears 130, 132 and 134, the rollers 120, 122 and 124 there include a tightening or drag mechanism, similar to drag mechanism found on fishing reels, that will enable the rollers 120, 122 and 124 to move freely when the user turns the adjusting knob(s) 138 to feed the clean mopping material 114*a*, yet will have enough drag to prevent the mopping material 114 from rolling back and forth as the user mops the floor F. Furthermore, the adjustable shaft 146 and slot 116*a* on the handle 116 will allow the user to move the roller pads 126*a* and 126*b* up and down in relation to the rollers 120, 122 and 124 of the roller mechanism 112 in order to make the mopping material 114 taut around the roller pad 126.

In operation, the user loads a roll 113 of mopping material 114 into the holder 111 and threads the mopping material 114 through the slot 115 at the bottom of the holder 111. The mopping material 114 is then fed between the first and second rollers 120 and 122 as one turns the adjustment knob 138 clockwise. This motion feeds the mopping material 114 down to the roller pad 126. As the user keeps turning the adjustment knob 138, the user takes the mopping material 114 around the roller pad 126 and then takes the leading edge of the mopping material 114 and feeds it between the second and third rollers 122 and 124. The second and third rollers 122 and 124 take hold of the mopping material 114 as the user keeps turning the adjustment knob 138 and feed the mopping material 114 up past the material cutter 119, which the user can use to tear or cut off excess moping material 114. The user then adjusts the tautness of the mopping material 114 by the adjusting the position of the roller pad 126 up or down along the mop handle 116.

In the process of mopping, as the mopping material 114 becomes soiled, the user simply rotates the adjustment knob 138 clockwise. The clean mopping material 114*a* automatically moves down into position on the roller pad 126 while the soiled material 114*b* automatically moves up past the second and third rollers 122 and 124 past the cutting device 119. As the soiled material 114*b* accumulates past the cutting device 119, the user simply takes hold of the soiled mopping material 114*b* and cuts the excess off, thus eliminating the need to roll the soiled material 114*b* back up.

These embodiments are meant to be illustrative examples and not exhaustive of the types of useful acoustic devices that can be built by patterning membranes or movable structures over cavities that are within a laminate or lead frame structure, nor of the methods of manufacturing said devices.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

The invention claimed is:

1. A mop comprising an elongate handle, a frame member comprising a supply roller, a take-up roller and a cross bar between the supply and take-up rollers, the handle coupled to the cross bar such that the supply and take-up rollers are positioned on opposite sides of the handle and the handle further including a portion thereof extending below the frame member, the frame member further including a guide roller positioned adjacent the take-up roller;

a roller pad rotatably coupled to an end of the handle portion that extends below the frame member, the roller pad having a soft or flexible exterior; and an elongate sheet of mopping material coupled to the supply roller, extending around the roller pad and the guide roller and then coupled to the take-up roller so that as the mopping material becomes soiled during use the dirty material may be collected on the take-up roller and a clean portion of the material supplied from the supply roller.

2. A mop comprising an elongate handle;

a frame member comprising first and second side supports and a cross bar extending there between, the handle coupled to the cross bar and further including a portion thereof extending below the frame member;

a mopping material holder positioned on the frame member on one side of the handle and cross bar;

first, second and third rollers disposed on the frame member below the mopping material holder, each of the rollers being engaged with and operably coupled with a respective one of the other rollers;

a roller pad rotatably coupled to an end of the handle portion that extends below the frame member, the roller pad having a soft or flexible exterior; and an elongate sheet of mopping material formed as a roll and disposed within the mopping material holder, the sheet of mopping material extending from the holder, between the first and second roller, over the roller pad and then between the second and third roller, wherein as the mopping material becomes soiled during use the dirty material may be fed between the second and third rollers and a clean portion of the material supplied from the holder.

* * * * *